United States Patent [19]

Bakay et al.

[11] Patent Number: 4,830,102

[45] Date of Patent: May 16, 1989

[54] TURBULENT HEAT EXCHANGER

[75] Inventors: Arpad Bakay, Bp.Riado u.; Janos Boda, Bp.Filler u.; Laszlo Forgo, Bp.Nephadsereg u.; Istvan Papp, Bp.Ady E. u.; Gyula Kovacs, Bp. Verhalom u.; Karoly Laszlo, Jaszbereny, Ady u., all of Hungary

[73] Assignee: Kulkereskedelmi Transelektro Magyar Villamossagi Vallalat, Budapest, Hungary

[21] Appl. No.: 70,672

[22] Filed: Jul. 2, 1987

Related U.S. Application Data

[63] Continuation of Ser. No. 242,669, Mar. 11, 1981, abandoned.

[30] Foreign Application Priority Data

Mar. 11, 1980 [HU] Hungary ..... 566/80

[51] Int. Cl.[4] ..... F28D 1/04

[52] U.S. Cl. ..... 165/151; 165/182

[58] Field of Search ..... 165/151, 109 R, 109 T, 165/182

[56] References Cited

U.S. PATENT DOCUMENTS

| | | | |
|---|---|---|---|
| 1,873,052 | 8/1932 | Seward | 165/182 |
| 2,428,145 | 9/1947 | Cook | 165/151 |
| 3,266,567 | 8/1966 | Oddy et al. | 165/151 |
| 3,438,433 | 4/1969 | Gunter | 165/151 |
| 4,169,502 | 10/1979 | Kluck | 165/151 |

FOREIGN PATENT DOCUMENTS

| | | | |
|---|---|---|---|
| 236342 | 11/1961 | Australia | 165/151 |
| 679809 | 2/1964 | Canada | 165/182 |
| 0086559 | 8/1983 | European Pat. Off. | 165/151 |
| 1121206 | 7/1956 | France | 165/151 |
| 345232 | 12/1936 | Italy | 165/182 |
| 558078 | 2/1957 | Italy | 165/151 |
| 55-96891 | 7/1980 | Japan | 165/151 |
| 121725 | 4/1971 | Norway | 165/151 |
| 561026 | 5/1944 | United Kingdom | 165/151 |

*Primary Examiner*—Ira S. Lazarus
*Assistant Examiner*—R. R. Cole
*Attorney, Agent, or Firm*—Klein & Vibber

[57] ABSTRACT

A heat exchanger having a plurality of parallel pipes arranged in lines and strips of fin plates fixed to the pipes perpendicularly to the lengths thereof. Turbulence-forming structures are cut out of the fin plates and are bent up at 90° with respect to the planes of the plates, such structures functioning as fin plate spacers and as baffles to direct a fluid medium of inferior heat transfer coefficient which flows in a direction parallel to the planes of the finned plates and perpendicularly to the pipes. The pipes are adapted to conduct a fluid medium of superior heat transfer coefficient. The turbulence-forming structures are disposed in lines on each side of the lines of pipes and in rows which are substantially tangential to the opposite sides of the pipes. The heat exchanger may have a plurality of lines of pipes spaced equally transversely from each other and transvetsely of the direction of flow of the fluid medium of inferior heat transfer coefficient. Further turbulence-forming structures may be disposed along the center line between the successive lines of pipes.

6 Claims, 2 Drawing Sheets

TURBULENT HEAT EXCHANGER

This is a continuation of application Ser. No. 242,669, filed Mar. 11, 1981, now abandoned.

The invention relates to a finned heat exchange special turbulence-forming structures are arranged perpendicular the surface of the surface of fin plates which are pulled or pushed onto the pipes, the turbulence-forming structures being arranged so as to ensure the efficient flow of a fluid heat transfer medium around the outer surfaces of the pipes.

The main feature of generally known finned heat exchangers is that the liquid or the steam having the superior heat transfer coefficient flows in the pipes or ducts, while the medium or inferior heat transfer coefficient, generally gas, e.g. air, flows along the fins perpendicularly fastened to the pipes.

The inferior heat transfer coefficient is equalized by the large surface of the fins, but the shape of the fins is not inconsequential. The heat transfer between the medium flowing along the surface of the fin is determined primarily by the speed, or the manner of flow of the medium. The manner of flow is influenced by two factors: partly by the turbulent or laminar nature of the flow, and on the other hand by the speed distribution along the surface of the fin.

In the case of gas or air flowing along the flat plate, a laminar limiting layer develops along the plate which constantly increases from the entering edge of the plate. The formation of this laminar limiting layer is avoidable by the breakup of the plane of the plate, by the formation of so-called miniature fins. The miniature fins ensuring turbulent flow thus far have been formed generally by cutting narrow strips of plate perpendicularly to the flow of the medium from the material of the plate; in certain heat exchangers these strips of plate were removed after cutting them out, so that the heat transfer surface was reduced.

When determining the number and arrangement of the turbulence-forming structures, it is necessary also to consider the matter of flow resistance and thermal conduction. Turbulence-forming structures should be used only at a place suitable from the fluid mechanical point of view, and in a specific number. It is well known that the turbulence-forming structures increase not only the heat transfer, but the flow resistance of the heat exchanger as well. Thus it is necessary to take into consideration the heat transfer and the effect of the flow resistance in relation to the total economic efficiency of the heat exchanger.

It is well known, that the heat travels by conduction in the fins of the heat exchanger. This means that, for instance, the temperature of the fin is highest at the pipe and that it decreases with distance from the pipe, while it is generally the lowest along the center line between the pipes. Consequently the turbulence-forming structures have to be arranged in such a way that the path of thermal conduction is not hindered, and where the temperature of the fin is the lowest.

Finally, it is necessary to deal with the matter of the speed distribution along the surface of the fin. The turbulence-forming structures are arranged so as to facilitate the uniformity of air distribution. It is well-known that the air distribution behind the pipe is not uniform. For this reason the uniformity of the flow can be improved by proper arrangement of the turbulence-forming structures. This is accomplished by arranging the turbulence-forming structures along the line of the outer surfaces of the pipes parallel with the flow direction.

The finned heat exchanger according to the invention meets the above principles and requirements by the arrangement of applied special, combined turbulence-forming structures which are entirely different from those existing so far, since the present invention simultaneously takes into account the fluid mechanical and thermodynamic aspects, and in addition the distance between the fins, so that the uniformity of the so-called fin distribution is ensured. Thus the new turbulence-forming structures have a triple function: fins with efficient heat dissipation structures influencing the medium flow, and fin spacers.

According to the main feature of the invention, turbulence-forming structures are formed on the surface of the plates of the finned heat exchanger, such heat exchanger consisting of circular pipes and parallel plates fixed perpendicularly to them, the turbulence-forming structures being ears bent up at 90° with respect to the plane of the respective plate and cut out of the plate by forming a central cut therein and angular cuts diverging from the opposite ends of the central cut, whereby to form two parallel ears of trapezoidal shape. Each pair of ears forms a turbulence-forming unit. The turbulence-forming units are arrange on the plane of the plate in such a way that they are disposed alternately along a line tangent to the row of pipes parallel with the direction of flow of the medium, and along the center line between confronting pipes which are disposed in adjacent or nearby rows and having their centers lying on a center line which extends at right angles to the direction of medium flow. The solution according to the invention is applicable both in the case of straight lines of pipes disposed in parallel rows wherein said confronting pipes are in successive rows of pipes, or in the case finned heat exchangers having the pipes in successive rows of pipes in a staggered arrangement.

In accordance with the third embodiments of the invention, the longitudinal dimension of the turbulence-forming structures parallel with the direction of flow of the medium is not in excess of the radius of the pipes. Preferably, the turbulence-forming structures are trapezoidal, the height of which equals the distance between successive plates, i.e. the fin spacing, and the diverging side edges of each of the ears which make up a turbulence-forming unit are disposed at an angle of from 45°–85° with respect to the plane of the plate from which the ear has been formed.

To facilitate the understanding of the invention, it is illustrated in the accompanying drawings, in which:

FIG. 1, which is labelled "Prior Art", is a view in cross section through a heat exchanger having conventional finned pipes;

Figure 1:
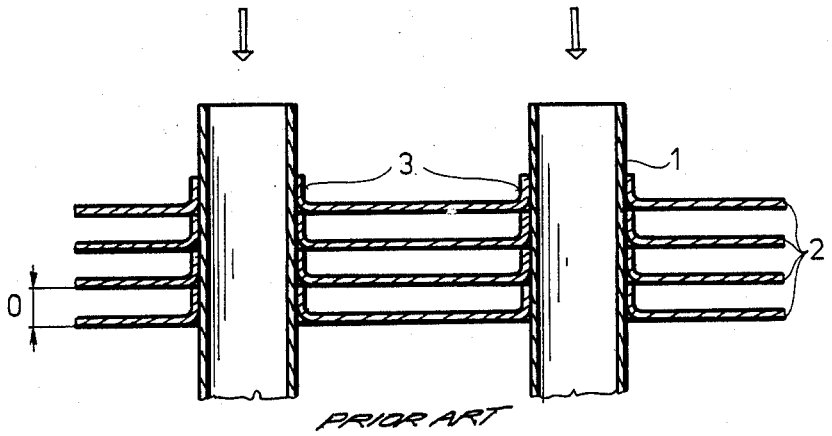

In FIG. 1, there is shown a conventional heat exchanger with finned pipes 1, in which the fluid medium of superior heat transfer coefficient flows through the pipes in the direction indicated by the arrows. Finned plates 2 on pipes 1 are disposed perpendicularly with respect to the longitudinal axes of the pipes. The plates are in tight engagement with the pipes through collar-like plate sections 3 formed from their own plate material. The collar-like plate sections 3 ensure that the fins remain spaced from each other through the desired distance.

Figure 2:
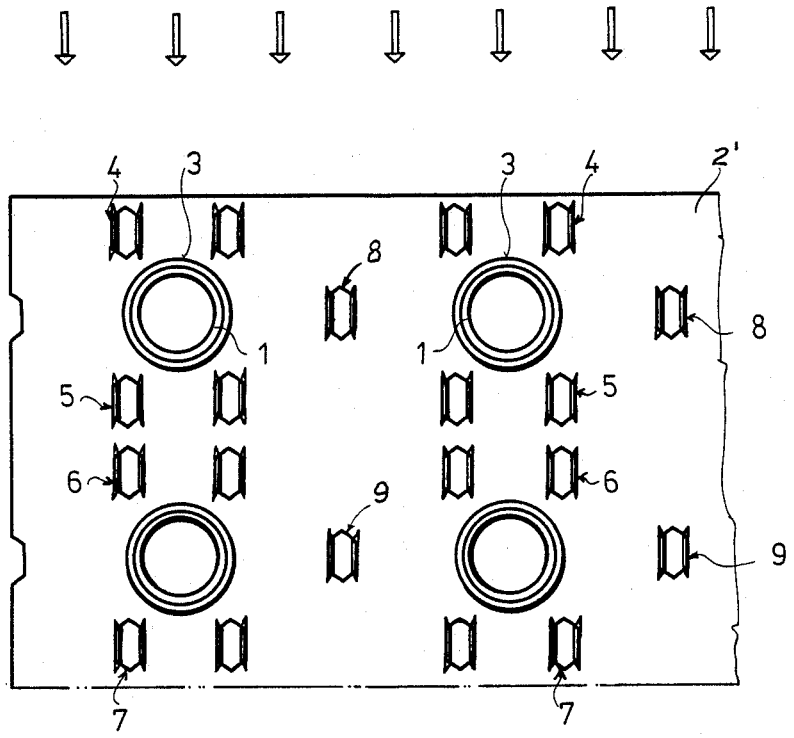
FIG. 2 is a view in plan of a plate of a first embodiment of the finned heat exchanger according to the invention, the successive rows of the pipes being arranged parallel to each other as with corresponding pipes in the respective rows having their center lines disposed at right angles to the direction of flow of the medium having the inferior heat transfer coefficient.

FIG. 2 is a plan view of a plate 2' of a first embodiment of finned heat exchanger according to the invention. In such embodiment, the pipes 1 are disposed in successive laterally space rows extending vertically in FIG. 2, corresponding pipes in successive rows having their center lines disposed on transverse lines extending at right angles to the direction of flow of the medium of lower heat transfer coefficient. The medium of superior heat transfer coefficient flows through the pipes 1, whereas the medium inferior heat transfer coefficient flows past the pipes in the direction vertically in FIG. 2, as indicated by the arrows.

Special, combined turbulence-forming structures 4–9, incl., are formed in the plate 1' as shown. Such turbulence-forming structures 4–9, incl., are ears which are formed by making a central cut and angular side cuts at each end of the central cut at the location of the ears, and bending up the two thus-formed ears in opposite directions to form two spaced parallel ears disposed at right angles to the plane of plate 2'. The turbulence-forming structures 4–7, incl., are arranged in the direction of the axes of the heat transfer pipes 1, the broad extents of the ears being disposed vertically in FIG. 2, that is, parallel to the direction of flow of the fluid medium of inferior heat transfer coefficient. The turbulence-forming structures 8 and 9 are arranged symmetrically about the center line extending between the centers of corresponding pipes 1 in successive rows of pipes. All of the turbulence-forming structures 4–9, incl., have the same construction. The central lines vertically of FIG. 2 between the ears of each of structures 4–7, incl., are substantially tangential to the outer surface of the pipes 1 in the respective rows of pipes.

Figure 3:
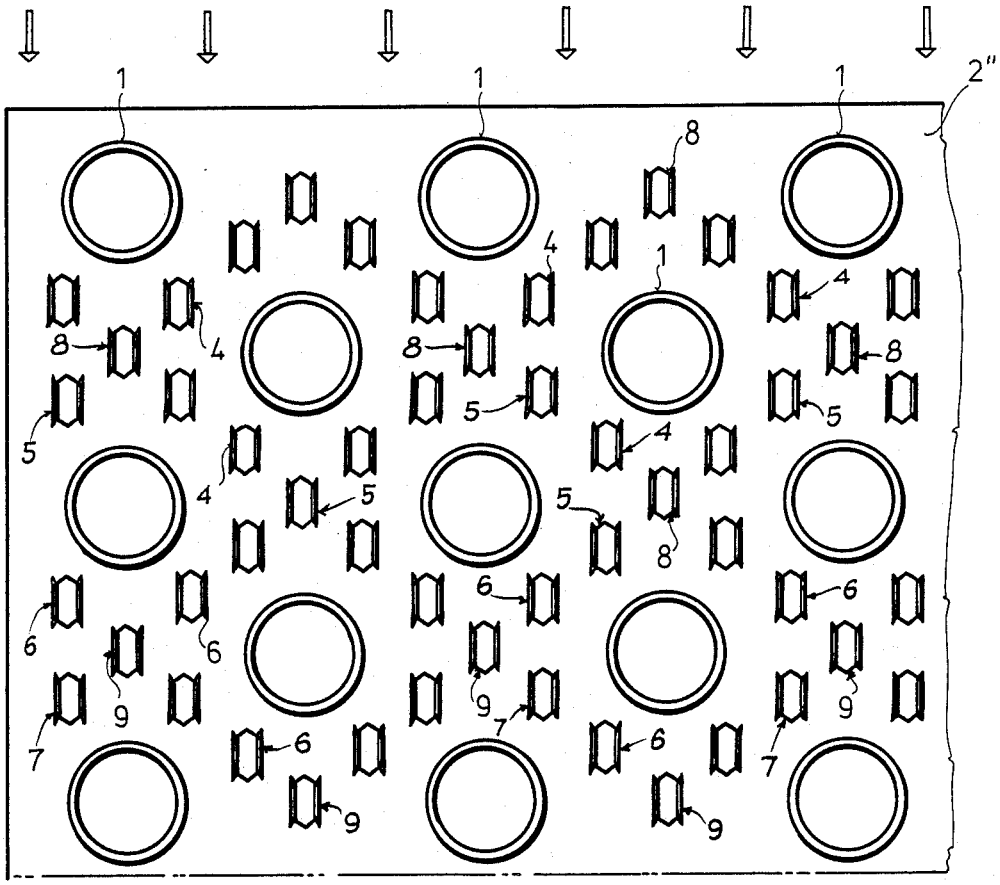
FIG. 3 is a view in plan of a plate of a second embodiment of the finned heat exchanger according to the invention, the pipes in successive rows thereof being disposed in displaced or staggered arrangement.

FIG. 3 is a view in plan of a plate 2'' of the finned heat exchanger according to the second illustrative embodiment of the invention. In such embodiment, the pipes 1 in successive lines of pipes shown extending vertically in FIG. 3, are displaced or staggered so that the respective pipes in alternate rows of pipes have their axes lined on transverse lines which are disposed at right angles to the direction of flow of the medium having an inferior heat transfer coefficient. As in the embodiment of FIG. 2, the turbulence-forming structures 4–7, incl., are arranged along vertical lines which are substantially tangent to the outer surfaces of the pipes in the respective rows of pipes. The turbulence-forming structures 8 and 9 are arranged centrally between successive pipes in the vertical rows shown in FIG. 3, structures 8 and 9 lying on the vertical lines connecting the axes of the pipes in each row.

Figure 4:
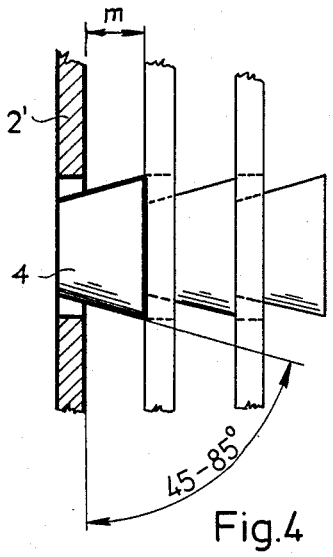
FIG. 4 is a view in side elevation of a turbulence-forming ear employed in the arrangement of the invention.

FIG. 4 illustrates a turbulence-forming ear which is taken as typical of all of the ears of turbulence-forming structure 4–9, incl. Ear 4 is one of the pair of trapezoidal ears cut out of the material of the plate 2' at each location of the turbulence forming structures. The horizontal distance m shown in FIG. 4 represents the distance between the confronting surfaces of successive plates 2'. As shown, the ear 4 acts as a distance-spacer between successive plates 2', the longer side of the trapezoidal ear 4 which is shown in full line engaging the confronting surface of the next successive plate 2'. Each of the diverging sides of the ear 4 lies at an angle of from 45°–85° with respect to the broad surfaces of the plate from which it was forced. The longer side of the trapezoidal ear has a length which exceeds the dimension of the opening through the next successive plate which it confronts. Thus, the ear on each of the plates 2' cannot slide into the cut-out portion of the next adjacent plate.

Although the invention is illustrated and described with reference to a plurality of preferred embodiments thereof, it is to be expressly understood that it is in no way limited to the disclosure of such preferred embodiments but is capable of numerous modifications within the scope of the appended claims.

We claim:

1. A heat exchanger comprising:

a plurality of parallel cylindrically shaped tubes arranged in line or staggered, said tubes designed to carry a first fluid medium, and a plurality of parallel plates perpendicularly disposed relative to said tubes and fixed thereto by means of cylindrically shaped flanged portions of said plurality of plates, said plates being spaced far enough apart to allow passage of a second fluid medium between them, each of said plates being provided with a plurality of turbulators, each of said turbulators comprising a pair of parallel ears formed by the cuts in the plate, said ears being trapezoidal in shape and being bent approximately 90 degrees with respect to said plate so as to expose a hole in a said plate with said ears adjacent to said hole, the free end of each ear abutting against an adjacent plate of said plurality of plates;

said turbulators being arranged in first and second sets, the centers of said first set of turbulators being arranged along a first imaginary line, said first imaginary line being at once substantially tangent to a row of tubes and parallel to the direction of incoming flow of said second fluid medium, and said ears of said turbulators being parallel to said first imaginary line, the centers of said second set of turbulators being arranged along a secondary imaginary line, said second imaginary line being at once perpendicular to the direction of incoming flow of said second fluid medium and passing through the centers of a row of tubes, the ears of said second set of turbulators being perpendicular to said second imaginary line.

2. A heat exchanger as claimed in claim 1 further comprising:

said ears functioning as spacers between adjacent parallel plates.

3. A heat exchanger as claimed in claim 1, wherein the parallel ears of adjacent turbulators are non-converging with respect to each other relative to the direction of flow of the second fluid medium.

4. A heat exchanger as claimed in claim 1, wherein the pair of parallel ears of each turbulators are spaced not farther apart at their upstream ends than at their downstream ends relative to the direction of flow of the second fluid medium by virtue of the fact that they are parallel.

5. A heat exchanger as claimed in claim 1, wherein the centers of a pair of turbulators of said first set of turbulators which are arranged along an imaginary line which is substantially tangent to a row of tubes are spaced a distance part from each other which is larger than the exterior diameters of said tube.

6. A heat exchanger as claimed in claim 1, wherein the trapezoidal angle of said trapezoidally shaped ears ranges from 45°-85°.

* * * * *